United States Patent [19]

Marleau

[11] Patent Number: 4,643,494

[45] Date of Patent: Feb. 17, 1987

[54] FRAMELESS, INTERLOCKING, MULTI-TRAY BOX

[76] Inventor: Gilles Marleau, 187 Eddy Street, Hull, Quebec, Canada, J8X 2X2

[21] Appl. No.: 597,175

[22] Filed: Apr. 5, 1984

[30] Foreign Application Priority Data

Apr. 7, 1983 [CA] Canada ..... 424118

[51] Int. Cl.[4] ..... A47B 87/02

[52] U.S. Cl. ..... 312/111; 292/120; 312/107; 312/218; 312/244; 312/DIG. 33

[58] Field of Search ..... 312/107, 107.5, 111, 312/108, 244, DIG. 33, 222, 216, 217, 218, 215; 292/120, 128, 42, 162

[56] References Cited

U.S. PATENT DOCUMENTS

| | | | |
|---|---|---|---|
| 489,274 | 1/1893 | Steel | 292/162 |
| 512,496 | 1/1894 | Autenrieth | 312/111 X |
| 806,320 | 12/1905 | Campbell | 312/107 |
| 813,376 | 2/1906 | Greenwood | 292/128 X |
| 1,507,110 | 9/1924 | Duncan | 292/128 X |
| 1,992,435 | 2/1935 | Labadie et al. | 312/244 X |
| 2,455,069 | 11/1948 | Launder | 292/120 X |
| 2,511,949 | 6/1950 | Simon | 312/107 |
| 2,628,752 | 2/1953 | Corkish | 312/244 |
| 2,807,387 | 9/1957 | Siciliano | 312/111 X |
| 3,330,608 | 7/1967 | Druger, Jr. | 312/111 |
| 3,441,146 | 4/1969 | Summers | 312/111 X |
| 3,722,927 | 3/1973 | Miska | 292/128 X |
| 3,728,003 | 4/1973 | Bohannon | 312/111 X |
| 4,084,865 | 4/1978 | Joyce | 312/111 |

FOREIGN PATENT DOCUMENTS

| | | | |
|---|---|---|---|
| 860150 | 9/1940 | France | 312/DIG. 33 |
| 1026570 | 4/1953 | France | 312/107 |
| 1075537 | 10/1954 | France | 312/111 |
| 526817 | 6/1931 | German Democratic Rep. | 312/111 |

*Primary Examiner*—James T. McCall
*Assistant Examiner*—Thomas A. Rendos
*Attorney, Agent, or Firm*—Murray Schaffer

[57] ABSTRACT

An interlocking box is disclosed. The box has no frame and may have as many horizontally sliding trays as desired. Each tray is slidably interlocked with the tray below (and/or above) and the box includes a unique lock/latch device in one end whereby it is interlockable with vertically adjacent trays, the lock/latch device permitting easy opening to the interior of any selected tray or trays. The box permits selective removal of one or more trays which may themselves be interlocked, with remaining trays also left in interlocked relationship.

2 Claims, 12 Drawing Figures

FRAMELESS, INTERLOCKING, MULTI-TRAY BOX

The invention relates to improvements in multi-level storage boxes or the like having two or more interlocking sections or trays with which horizontally lock/latch means are also provided, whereby each box level may selectively be opened, with the remaining levels remaining in lock relationship. As many sections or trays as desired may be combined.

The box provided is capable of many uses, such as a tackle box, tool box, utility box, jewelry box, sewing box, artists box, lunch box, as well as many other uses which will be self-evident, and one box, if desired, may serve all these functions.

As each tray is interlockable with all other trays, the user may select only those trays holding tools or materials required for a specific function, and leave the remaining storage trays, also in interlocked relationship, at home, office, in his automobile, or the like, thus minimizing the size and weight of the storage box when on a specific outing, as to a repair job, fishing expedition, painting site or the like.

The user may selectively remove one or more trays from the box, and if two trays, for example, are removed, these may be themselves maintained in interlocked relationship, while the tray or trays being left behind may also be left in locked relationship.

The box is extremely solid because of its design and construction, and includes a unique locking system. The levels of the box may be selectively opened on either side of the box, to expose the contents of the tray below. The box has the further advantage that the user may purchase as few or as many box tray sections as desired, and, for example, would initially purchase a top and bottom unit, and then add additional intermediate trays, as required, all of which are interchangeage and interlockable with the top and bottom units.

As each tray of the box according to the invention may include individual compartments, created by partitions therein, as desired, contents contained within the box according to the invention will remain safely in place, and contents cannot spill, into another tray or compartment, as is the case with most known multiple compartment storage boxes now available. However, the complete interior space of each tray is in fact the same size as the box. In other words there is no loss of interior space as is common in known storage boxes, as a result of trays being inserted within a container, or as a result of hardware as found for example in almost all fishing tackle boxes which have hinged trays mounted to pivot outwardly. Should the box be used for fishing tackle, because each tray is substantially airtight when the box is in closed position, it will float in the event that it should be dropped into the water. Additionally, should the fisherman be going on a fishing trip specifically for trout, for example, the trays of the box containing other fishing tackle designed specifically for other fish such as pike, pickerel, or the like, may be left behind and he need carry only tray or trays including the desired equipment. Should it appear that rainy weather is in the offing, then a tray in which rain gear is stored may also electively be included in the box, and if tools would be required on an outing, as for servicing an outboard motor, a tray including such tools could also be interlocked in the box.

A further object of the invention is to provide a box made of components which are molded, or otherwise pre-formed, and which permit quick, simple, and efficient assembly at the factory, without tools.

A principal object of the invention is to provide a frameless, interlocking, multi-tray box comprising: a plurality of trays; lock/latch means in one end of each tray; each tray being adapted, selectively, to be slidably interlocked on top of any other tray and to be horizontally slidable thereon: said lock/latch means in each tray co-operating to maintain said trays in locked, vertical alignment; said lock/latch means including release means whereby a tray may be slidably moved horizontally to permit access to the tray below, and said lock/latch means including means to latch a tray in said last name position.

Reference will be made to the accompanying drawings in which:

FIG. 1 is a perspective of an interlocked top section and base section, with a drawer illustrated in ghost projecting from the top section;

FIG. 2 corresponds with FIG. 1 with the top section in open position on the base, and the drawer closed;

Detailed reference will now be made to the drawings wherein like reference numerals will identify like parts.

Figure 1:
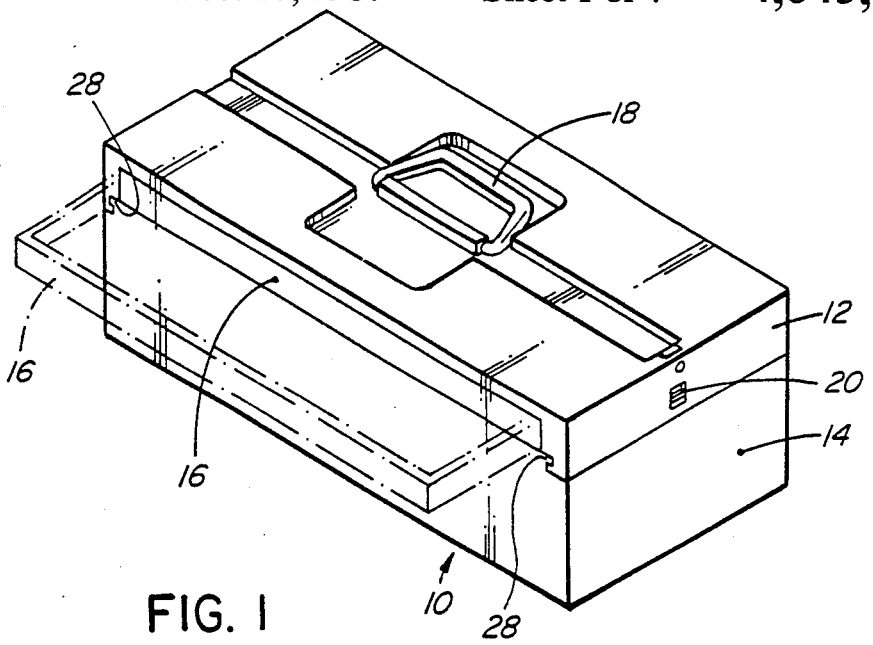

In FIG. 1 a box according to the invention is indicated generally at 10 comprising a top section 12 and a base section 14. Shown in ghost is a drawer 16 projecting partly from top 12, drawer 16 being slidable to a position completely contained within top 12 as will be understood by those skilled in the art, and drawer 16 may be retained within top 12, by a magnetic restraint, friction latches or the like.

As will become clear hereinafter drawer 16 is also locked within top 12, by a lock-pin associated with the lock/latch mechanism disclosed, and a detailed description of this lock arrangement will be made hereinafter.

A handle 18 is shown pivotally mounted on the top surface of top 12, and may be recessed, as illustrated, so as to eliminate any projection from the top surface of the box 10. A lock/latch finger 20 is illustrated on the side wall of top 12, lock/latch finger 20 being flush with the box side within a recess provided in the side wall of top 12. The box, in fact, is free of any projecting parts and is thus incapable of snagging objects as it is moved.

Figure 2:
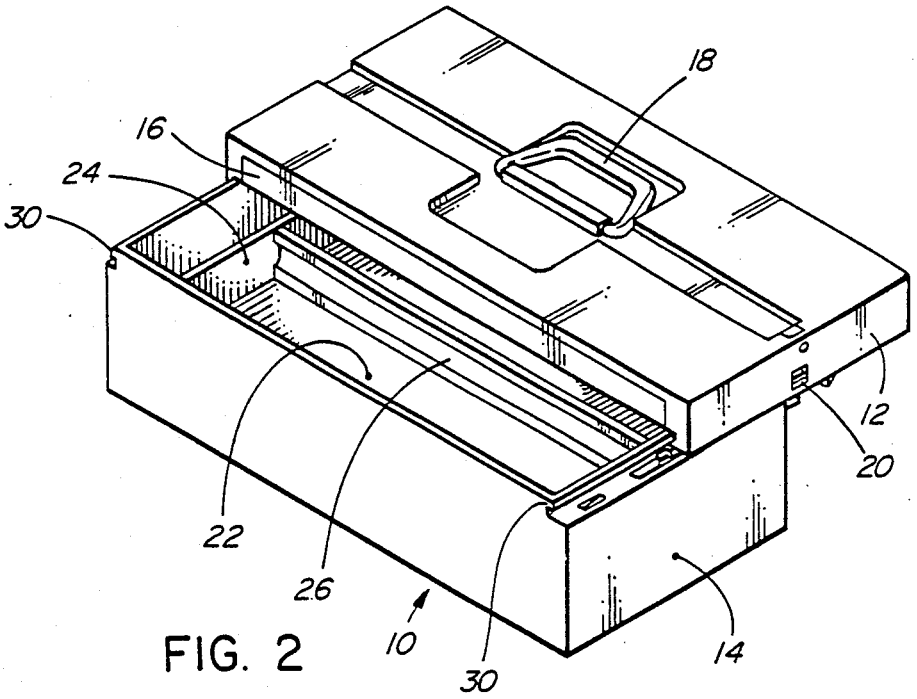

As seen in FIG. 2, top 12 has been slidably opened, to expose the interior 22 of base section 14, which may include a removable tray, which might be used, for example, to contain tools or the like, as will be clearly understood by those skilled in the art.

As is clearly illustrated in FIGS. 1 and 2, top 12 is adapted to slide horizontally on base 14 (when lock-/latch finger 20 has been released), top 12 being provided with a groove 28 on the interior of end panel 12 (and a corresponding groove 28 at the end panel opposite panel 12), grooves 28 being adapted for slidable interlocking relationship with a pair of lips 30 provided along the top edge of each end of base 14.

Figure 3:
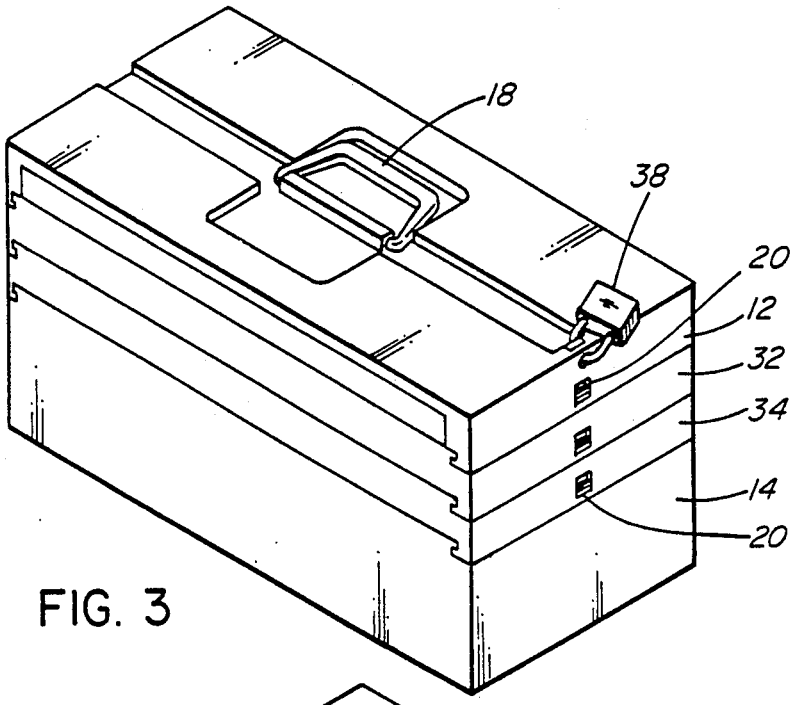
FIG. 3 is a perspective view of a frameless, interlocking, multi-tray box according to the invention in closed position.
Figure 4:
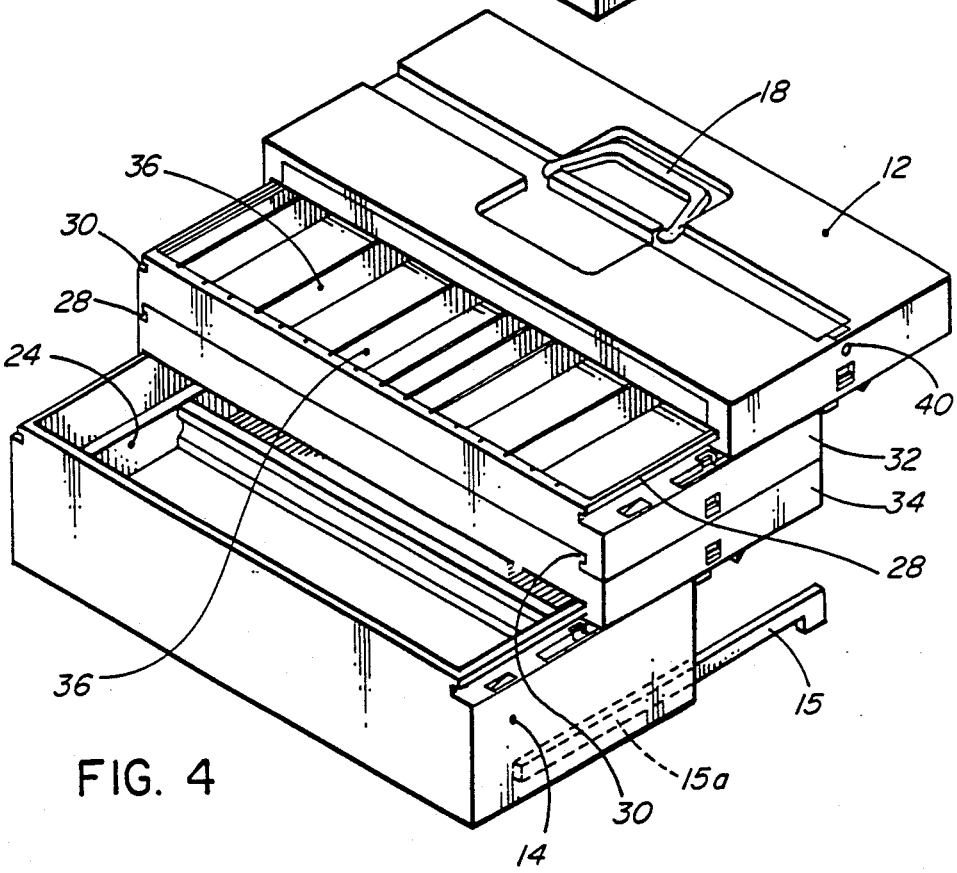
FIG. 4 is a perspective view of the box of FIG. 3 with two of the trays in open position.

In FIG. 3 a frameless, interlocking, multi-tray box is illustrated, corresponding with that illustrated in FIG. 1, but with two additional interlocking trays 32 and 34 interposed in slidable interlocked relationship between top section 12 and base section 14. In FIG. 4 the embodiment of FIG. 3 is illustrated, with tray 32 being open, as well as base 14. It will be seen that tray 32 is provided with compartments created by a plurality of interior partition walls 36. Tray sections 32 and 34 are provided with lips and grooves 28, 30, at each end thereof whereby tray sections 32, 34, are slidably interengaged.

As seen in FIG. 4 an L-shaped support leg 15 proejcts rearwardly from the bottom of base section 14, and is adapted to be received within an opening 15*a* illustrated in broken lines in FIG. 4. Support leg 15 is provided in the event that a plurality of the trays of box 10 are loaded with relatively heavy objects, and it is desired to open a number of trays in the manner illustrated in FIG. 4, support leg 15 acting to prevent the box from tipping over. Support leg 15 will not be required, except in relatively unusual circumstances, as the individual trays may be opened from either side, so as to prevent the imbalance illustrated in FIG. 4.

Also illustrated in FIG. 3 is a padlock 38, engaged in an opening 40 (also see FIG. 4) and as will become clear hereinafter, lock 38 acts to maintain all tray sections in the closed and locked position illustrated in FIG. 3.

Figure 5:
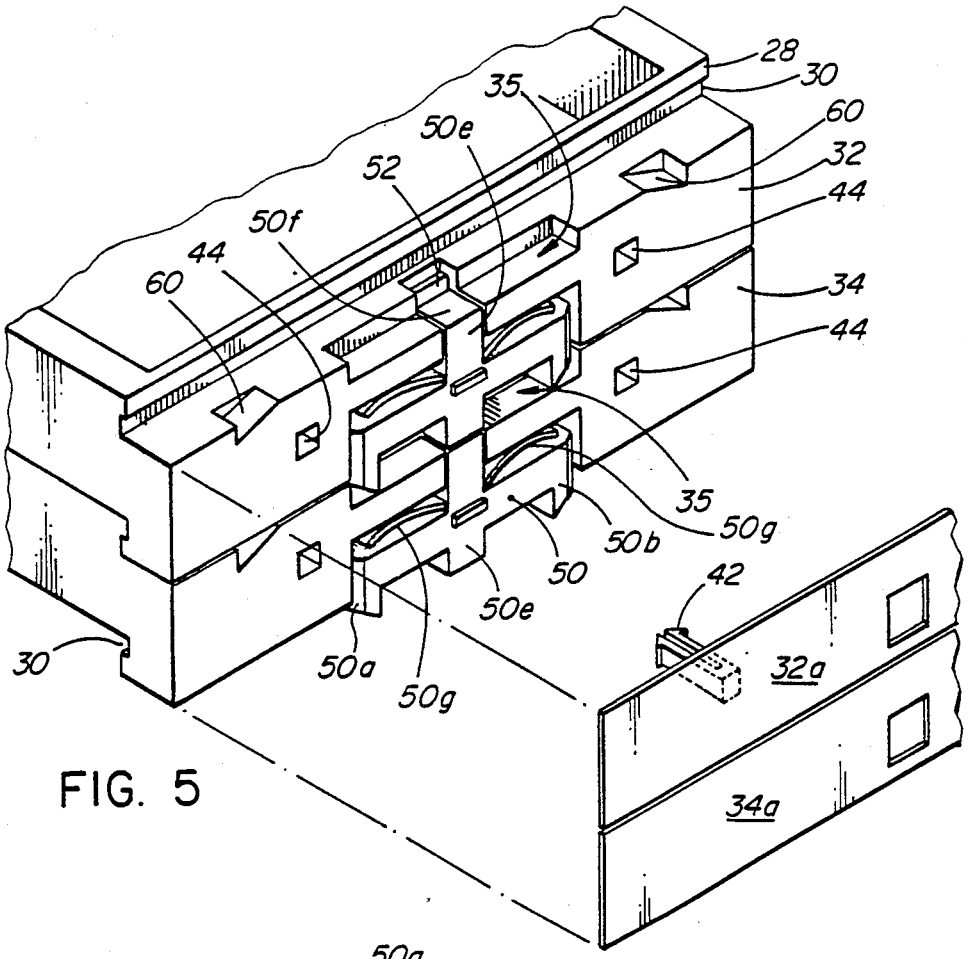
FIG. 5 is a detail of a lock/latch mechanism for use with the box, with lock-cover plates in exploded view.

In FIG. 5, tray sections 32 and 34 are illustrated, with a lip 28 and groove 30 also being clearly illustrated. Face plates 32*a* and 34*a* of tray sections 32 and 34, respectively, are illustrated in exploded view. Face plates 32*a* and 34*a* are adapted to be retained on the ends of tray sections 32 and 34 by spring-clips, such as clip 42 illustrated projecting inwardly from face plate 32*a*, clips 42 being adapted to be removably received in openings 44 provided in the end wall of tray sections 32, 34, as illustrated. It will thus be appreciated that assembly of the frameless, interlocking, multi-level storage box according to the invention, when the components are molded, is very simple. The insertion of spring locks 42 in the end walls of tray sections, when lock components have been put in place is quick and efficient. Further, should the multi-level storage box according to the invention be used in a relatively dirty environment, such as by a fisherman on a sandy beach, cleaning of lock components is again very quick and simple, as face plates may be readily and efficiently removed by the user, by closing spring fingers 42 on the interior of tray compartments, so as to release the face plates, and permit ready cleaning of the interior lock components and compartments.

Figure 6:
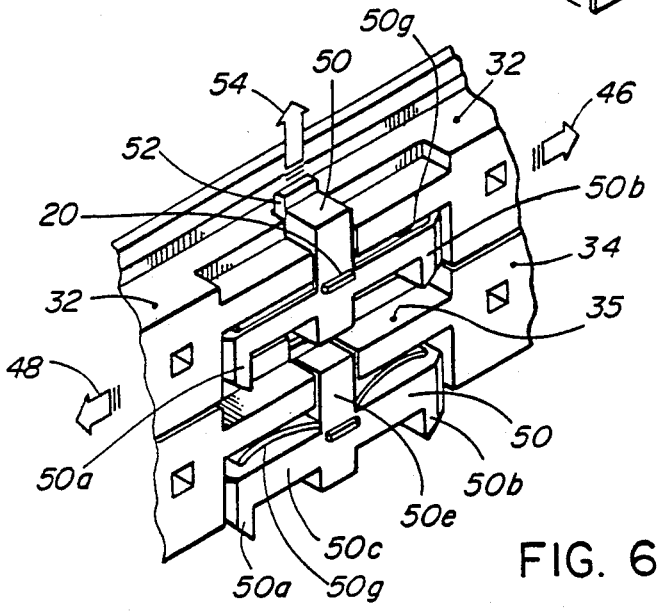
FIG. 6 is a further detail of the lock/latch mechanism of FIG. 5.

In FIG. 5, the tray locking mechanism is illustrated in locked position, while the detail in FIG. 6 shows the tray section 32 locking mechanism in open position, this mechanism having manually been raised by lock/latch finger 20, so that tray section 32 is free to slide either in the direction of arrow 46, or in the direction of arrow 48.

A detailed description of the lock/latch mechanism employed in the invention will now be made, with particular reference to FIGS. 5 through 8.

Figure 8:
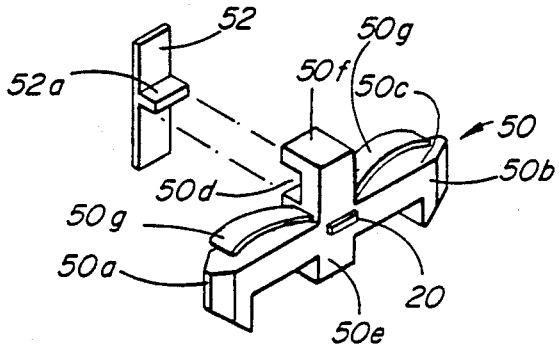
FIG. 8 is a perspective detail of the lock/latch components.

Referring firstly to FIG. 6, the lock/latch associated with each tray includes only two moving parts, namely, a cross-shaped member indicated generally at 50 in FIG. 8, and a T-shaped member 52. It will be seen that cross-shaped member 50 has a pair of downwardly extending beveled ends 50*a* and 50*b*, one at each end of its horizontal transverse arm 50*c*, and a central indentation 50*d* in the upper end of its vertical arm 50*f*, on the side opposite lock/latch finger 20. Projecting upwardly from transverse arm 50*c* are a pair of unitary spring wings 50*g*, one on each side of vertical arm 50*f*. T-shaped member 52 includes a horizontal, short stem 52*a*, adapted to be received in indentation 50*d* of cross-shaped member 50.

As seen most clearly in FIGS. 5 and 6, lock/latch parts 50 and 52 are adapted to be received in recesses 35 provided in one end of each tray, trays 32 and 34 being illustrated in FIGS. 5 and 6.

As seen in FIG. 5, with both lock/latch parts 50 and 52 in closed position, the center vertical arms 50*e* of cross-shaped lock members 50 are in abutment, with beveled end portions 50*a* and 50*b* projecting downwardly below the lower edge of the associated tray within recesses 35 and if reference is made, for example, to tray 34 of FIG. 5 the downwardly extending beveled ends 50*a* and 50*b* of cross-shaped member 50 will be seen to project slightly below the bottom thereof. It will be further seen that the top of recess 35 provided in the end of tray 34 is spaced above the top of horizontal arm 50*c*. It will also be seen, with reference to FIGS. 5, 6 and 7 that spring wings 50*g* are in normal contact with the bottom surface of the associated notch 35. So that when lock/latch member 50 is urged upwardly in order to open a tray that spring wings 50*g* will be slightly compressed, and when lock/latch member 50 is released by the user spring wings 50*g* will urge member 50 downwardly. As will become clear hereinafter, the provision of the spring means 50*g* ensures effective latching of adjacent trays. The cross-shaped lock/latch member 50 associated with tray 32 in FIG. 6 has been manually raised against the spring action of spring wings 50*g*, in the direction of arrow 54, so that the beveled end of downwardly depending arms 50*a* and 50*b* are elevated fractionally above the top surface of the end of tray 34 permitting tray 32 to be slidably urged either in the direction of arrow 46 or arrow 48, so as to permit access to the interor of tray 34 therebelow.

When T-shaped member 52 is at rest, with its horizontal stem 52*a* engaged within notch 50*d* of cross-shaped member 50, the upper end of T-shaped member 52 projects slightly above the top face 50*f* of cross-shaped member 50 (see FIGS. 5 and 8). It will also be seen that when stem 52*a* or T-shaped member 52 is at rest within notch 50*d* of cross-shaped member 50 that the top of T-shaped member 52 is slightly below the top surface of its associated tray as is seen in FIG. 5 where the top of T-shaped member 52 can be clearly seen. However, when the lock is raised in the direction of arrow 54 (see FIG. 6), the top of T-shaped member 52 is seen to project slightly above the top surface of tray 32, where it is adapted to engage in a notch provided in the bottom of the tray thereabove, so as to prevent relative movement therebetween, and to act as a temporary latch as tray 32 (and the tray or trays immediately thereabove) are moved to either side of the box 10, thus exposing the interior of tray 34 therebeneath.

Figure 7:
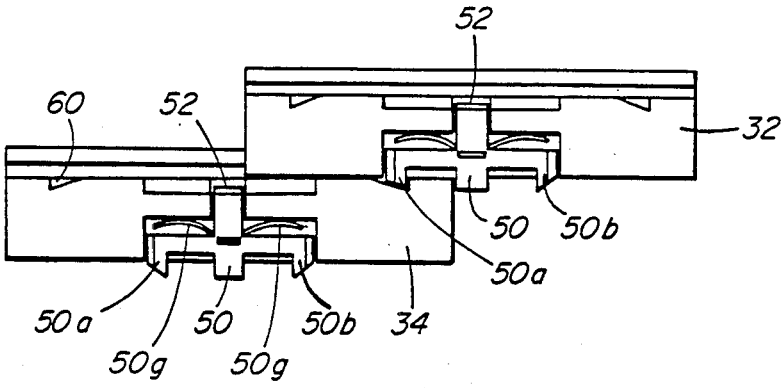
FIG. 7 is a side elevation of two trays, with lock-cover plates removed.

When cross-shaped member 50 is elevated (through manual urging of lock/latch finger 20 in an upward direction) it will be seen that T-shaped member 52 is also elevated, to engage a notch in the bottom surface of the tray positioned above. Referring to FIG. 7, it will be seen that tray 32 has been moved to one side of tray 34, with one beveled end of cross-shaped member 50 (end 50*a*) engaging a triangular notch 60 provided in the upper surface of tray 34, with the center of cross-shaped member 50 engaging the outer end of tray 34, effectively locking tray 32 in the position illustrated, above tray 34, with the interior of tray 34 partially opened. As the lock assembly of tray 32 is moved from closed position to the open position illustrated in FIG. 7 the upper end of T-shaped member 52 will have engaged the notch provided in the tray thereabove (not illustrated), and be frictionally engaged therein as tray 32 is slidably moved to the position illustrated in FIG. 7. The cross-shaped member 50, however, remains above the upper edge of tray 34, only until it reaches the position illustrated in FIG. 7 when it will be urged by spring wings 50*g* to the position illustrated, wherein beveled end 50*a* has engaged the triangular notch 60 in the top surface of tray 34, thus preventing any further sliding movement of tray 32. As beveled end 50*a* engages notch 60, further sliding movement of the tray is no longer possible, and only when the user again urges finger 20 of cross member 50 upwardly is it possible to completely remove a tray.

As the user opens a tray, for example 32, by exerting upward pressure on finger 20 of cross-shaped member 52, the upper end of T-shaped member 52 will engage the notch of the tray thereabove, and at the same time all of the cross-shaped members associated with the trays above tray 32 will also have been urged upwardly. In other words, the trays above tray 32, in an instant chain reaction will have been engaged with the trays thereabove, and will be moved along with tray 32 as it is slid horizontally in either direction until cross-shaped member 50 falls to its lowermost position within notch 50*d*, following release by the user, when arm 50*f* again rests on the bottom of notch 35.

During the creation of the lock/latch mechanism disclosed, T-shaped member 52 was initially not thought to be necessary, and cross-shaped member 50 was provided with a simple short finger extending upwardly from the top inner edge thereof. It was found, however, that the frictional engagement between the tray above the tray being moved permitted the trays in motion to proceed beyond the latched position illustrated in FIG. 7. The provision of T-shaped member 52 eliminates this danger, as cross-shaped lock/latch member 50 is urged by spring wings 50*g* to the latched position illustrated in FIG. 7, and cannot proceed beyond that point during travel of tray 32, unless the user maintains an upward pressure on finger 20 of cross-shaped member 50 in order to remove a tray or trays. If latch finger 20 has been released before the trays reach the relative positions illustrated in FIG. 7, then latching will occur as described above.

It will be further appreciated that when the latch finger 20 of tray 34 is raised, that each of the cross-shaped members 50 positioned thereabove are also raised, thus engaging the tip of T-shaped members 52 in the notches provided in the trays thereabove, whereby tray 34 is free to be slidably moved in one direction or the other, relative to base 14, with trays 32 and any additional trays thereabove being maintained in vertical alignment with tray 34. Thereafter, as desired, tray 32 may be moved in either direction, should it be desired to examine and have access to the contents of the tray below.

Referring again to FIG. 5, it will be seen that when the latch mechanisms are in the at-rest position illustrated, adjacent trays are restrained from relative movement inasmuch as the lower ends of arms 50*a*, 50*b* (and 50*e*) are contained within the lock/latch notch 35 of the tray immediately below. As seen in FIG. 3, an opening is provided to accommodate the hasp of a lock 38, in top section 12, and with lock 38 engaged therein it is not possible to open any of the trays.

It will further be appreciated that if any tray or trays are to be removed from the assembly latch finger 20 thereof is maintained in its elevation position and such tray(s) may then be moved completely off the tray therebelow, that is, past the notch 60 adapted to receive one of the beveled ends of cross-shaped member 50.

Figure 9A:
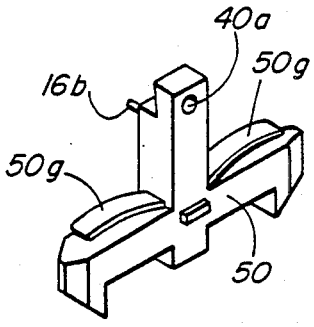
FIG. 9 is a perspective view of a lock/latch component for use in the cover of a box, together with a side elevation thereof.
Figure 9B:
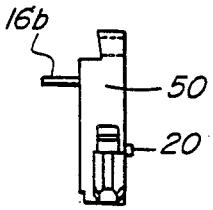
Figure 10:
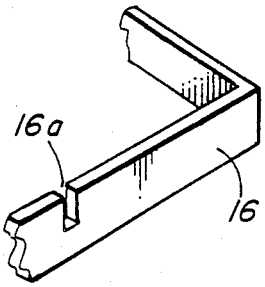
FIG. 10 is a detail of a drawer for use in a cover of the box.

Referring now to FIGS. 9 and 10, cross-shaped member 50 illustrated in perspective, and in side elevation in FIG. 9 is provided for use with a cover member of a box according to the invention, as illustrated in FIGS. 1 through 4. It is not necessary to provide a T-shaped member for use with the uppermost cover of a box, for self-evident reasons, in other words, the T-shaped member is only necessary when there is a tray adapted to be mounted thereabove. However, it will be seen that cross-shaped member 50 for use with a cover does include spring wings 50*g*. It will be further seen that a lock pull 40*a* is provided to co-operate with lock 38 (see FIG. 3), when it is desired to leave an assembled box in locked position.

A section of tray 16 provided for slidable engagement in top 12 is illustrated in FIG. 10, and it will be seen that the end wall thereof is provided with a narrow slot 16*a* adapted to engage a pin 16*b* projecting from cross-shaped member 50 associated with top 12. Thus, when it is desired to open drawer 16 the user elevates cross-shaped member 50 of top 12, to raise pin 16*b* above the slot 16*a* of drawer 16, to permit opening thereof. Pin 16*b*, under the urging of spring wings 50*g* will re-engage slot 16*a* when drawer 16 is closed.

Figure 11:
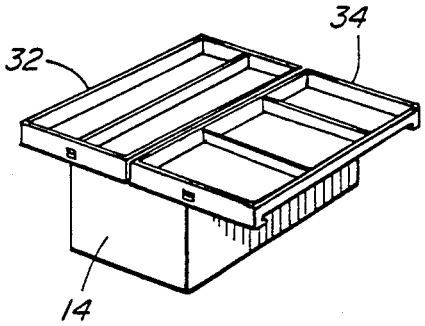
FIG. 11 is a perspective illustrating how the box may be used for easy display purposes.

Referring to FIG. 11, a display arrangement is illustrated, where trays 32 and 34 are both mounted on box bottom section 14, in latched relationship, in other words, the inner edges of trays 32 and 34 are each latchably engaged within notches 60 of base section 14. In the configuration illustrated in FIG. 11, further, should it be desired to move the display container so formed, top 12 could further be slidably interlocked thereon, centrally, with its lock/latch 50 engaging a locking notch 60 on each of trays 32 and 34.

It will be further appreciated that any tray section such as 32 or 34 is capable of being used as a base section. In other words should trays 32 and 34 be removed, they may be releasably interlocked, and transported as desired, with the bottom tray serving as a base.

These and other objects of the invention will be apparent to those skilled in the art, and the invention should be limited only by the claims appended hereto.

The embodiments of the invention in which an exclusive property or privilege is claimed are defined as follows:

1. A frameless, interlocking, multi-tray box comprising:

a plurality of trays having front and rear walls and opposed side walls;

each tray being interlockable on top of any other tray so as to be vertically attached therewith and horizontally slidable thereon, each tray having a groove and lip in the outer and inner surfaces of each of its side walls cooperating with a correspondingly formed and situated groove and lip in adjacent trays;

lock/latch means in at least one of said side walls of each tray;

said lock/latch means in each tray cooperating to maintain said adjacent trays in locked, vertical alignment, and having release means whereby a tray may be slidably moved horizontally to permit access to the tray below;

said lock/latch means comprising a pair of lock/latch members contained within a recess provided within said at least one side wall of each tray, the first of said lock/latch members including a pair of downwardly projecting beveled fingers engageable in notches provided in the upper surface of said at least one side wall of the tray interlockably engaged therebelow, the second of said lock/latch members being T-shaped, the horizontal stem of said T being engageable within a notch provided in said first lock/latch member, said first lock/latch member having a projecting finger whereby it may be manually raised to elevate said T-shaped member, said T-shaped member projecting upwardly above said first lock/latch member, and being engageable within a notch provided on the underside of the tray interlockably engaged thereabove, each of said T-shaped members when manually elevated, elevating all T-shaped members thereabove and temporarily latching said trays together so that they may be moved together as a unit;

said first lock/latch member including unitary spring means normally urging said first lock/latch member downwardly;

each of said trays being selectively positioned so as to be locked in vertical alignment with the trays above and below, horizontally movable to a latched position with the tray above exposing the interior of the tray therebelow, and to be completely removable from said box.

2. A frameless, interlocking, multi-tray box according to claim 1 and including a base section and a top cover section slidably engageable therewith.

* * * * *